United States Patent [19]

Pellegri

[11] Patent Number: 4,468,815

[45] Date of Patent: Sep. 4, 1984

[54] BATHING CAP

[76] Inventor: Alberto Pellegri, Viale Dante 53, 21016 Luino (VA), Italy

[21] Appl. No.: 495,155

[22] Filed: May 17, 1983

[51] Int. Cl.[3] ..... A42B 1/12

[52] U.S. Cl. ..... 2/68; 2/197; 2/183; 2/235; 2/236; 2/237

[58] Field of Search ..... 2/68, 197, 183, 235, 2/236, 237, 232 A, 221

[56] References Cited

U.S. PATENT DOCUMENTS

| | | | |
|---|---|---|---|
| 886,894 | 5/1908 | Thompson et al. | 2/237 |
| 1,022,410 | 4/1912 | Freedman | 2/221 |
| 1,106,818 | 8/1914 | Kaufler | 2/221 |
| 1,709,508 | 5/1929 | Weiner et al. | 2/237 |
| 3,206,761 | 9/1965 | Melnikoff | 2/68 |

FOREIGN PATENT DOCUMENTS

| | | | |
|---|---|---|---|
| 1230390 | 3/1960 | France | 2/237 |

*Primary Examiner*—Werner H. Schroeder
*Assistant Examiner*—Mary A. Ellis
*Attorney, Agent, or Firm*—Charles A. Muserlian

[57] ABSTRACT

A bathing cap incorporating a deployment clip in its rim which varies the circumference of the rim of a certain segment is very practical and comfortable to use.

The cap may be put on and taken off in an easy and comfortable way while its tightness in use is unimpaired.

5 Claims, 6 Drawing Figures

BATHING CAP

BACKGROUND OF THE INVENTION

The use of bathing caps is often prescribed in swimming pools for cleaniness and hygienic reasons, moreover their use in free waters is desirable to protect the hair, which, because of its nature, retains salts and other impurities present in the water, thus requiring far too frequent shampooing which becomes very harsh on the hair.

The bathing caps commonly available, on the other hand, are troublesome to use because, since they rely solely on the stretching of the elastic material which they are made from, to afford tightness around the head, their use is often devastating for hair-dos. Even prescinding from aesthetic consequences, the act of arranging the cap over large shocks of hair is difficult and often accompanied by painful discomfort, specially when trying to insert the last recalcitrant locks under the shelter of the cap.

There have been different suggestions in the past to provide bathing caps more comforable to use, which made use of various types of fastening means, however, these proposals did not find acceptance because either they were unpractical or they proposed cumbersome and expensive fastening means, hardly incorporable in the rubber caps commonly produced.

For example, in U.S. Pat. No. 2,465,998 it is described a bathing cap having one or more zippers to draw segments of the cap together over a sealing web.

The bathing cap described in U.S. Pat. No. 1,926,937 uses straps and a buckle to tighten the rim.

Again the headgear described in U.S. Pat. No. 3,710,393 in its embodiment depicted in FIG. 12 describes the use of a zipper and of a belt to close fit the cap over the head of the wearer.

OBJECTS OF THE INVENTION

Object of the invention is the provision of a bathing cap more comfortable to use and without the shortcomings of the known caps.

GENERAL DESCRIPTION OF THE INVENTION

The bathing cap of the invention is provided with an extremely simple deployment clip which allows to vary the circumference of the rim of a certain preset segment.

With the deployment clip unfolded, the dimensions of the bathing cap are such as to permit to put it on and to properly arrange it painlessly and comfortably over the hair. The clip may then be folded and locked thus insuring the necessary tightness around the head during use.

Of course the inverse operation allows to remove the cap from the head under the same conditions of practicalness as when it was put on.

The deployment clip is incorporated with or fixed by any suitable means to the rim of the cap and essentially it comprises two segments of a sufficiently rigid material, preferably having a flat cross-section, for example two metallic or plastic bars from about 3 to about 10 centimeters long, disposed in line one after the other and hinged together about their adjacent ends.

The way the hinging is realized is not strictly important as long as the two bars are made capable of rotating from their relative position on superimposed or parallel planes to a co-planar relative position and viceversa.

The clip is completed by a locking device capable of blocking the two bars in their relative position on superimposed planes.

Conveniently the locking device may be an automatic or press button or a butterfly button although other fastening means may be resorted to.

Preferably, in the case a press button is used, the male part of the button can be mounted on one of the two bars fixed to the rim of the cap and the female part of the button on the other bar, in such a way that by overlapping the two bars of the clip, the two parts of the button match operatively.

The two bars forming the clip are incorporated or fixed to the rim of the cap and upon folding the clip close the rim and the cap itself fold over or about the rotating bar, the elastic material with which the rim is made stretches that much around the head as to insure a sufficiently tight fit.

It is interesting to note that the variation of the circumference of the rim of the cap is pre-established and essentially it corresponds to twice the length of the one bar which is rotated until it is made to overlap the other bar which remains in place.

Therefore, in a preferred embodiment of the invention, the two bars of the clip do not have the same length but they have preferably different lengths thus allowing two distinct possibilities of varying the circumference of the rim of the cap depending on which one of the two bars is rotated to overlap the other.

This preferred embodiment of the clip coupled with the fact that at least the material of the rim or of the entire cap is substantially elastic allows to produce a bathing cap which is capable to fit a very large range of sizes of users.

As it will be obvious to the reader, the two segments of the deployment clip, defined above as sufficiently rigid, may also be made of a material which, per se, could be recognized as rather flexible. That is the definition of substantial rigidity must be intended as functional, in the sense that the two segments or bars of the clip must be that rigid as not to be flexed back by the elastic traction resulting from the stretching of the rim of the cap upon the closing of the clip.

Also the way the hinging of the two segments of the clip is realized may be different.

For example, using two metallic bars the hinge may be of the classical type utilizing a pin as the pivoting means. On the other hand, using a plastic material having a high yielding endurance to repetitive bending, it is possible to use a single integral bar of the material provided with a suitable necking of its cross-section in correspondence of the point where the material must be able to bend repeatedly without breaking.

According to a preferred embodiment of the invention the elastomeric material with which the rim of the cap is made provides itself for the hinging means of the clip. The two segments of the clip are simply fixed individually to the rim of the cap in such a way that their adjacent ends almost abut one against the other or remain slightly spaced apart for up to about 3 millimeters.

The elastic material of the rim of the cap is per se resistant to repetitive bending and constitutes a membrane type hinge of the clip. Optionally the material of the rim may be purposely reinforced in correspondence of the hinging of the clip by suitably making the section thicker in that particular zone during the moulding of the cap.

DETAILED DESCRIPTION OF PREFERRED EMBODIMENTS

The description continues with reference to the appended drawings which illustrate some preferred practical embodiments of the invention.

It is intended that the invention is not limited in any way to the embodiments described in the drawings of which:

The bathing cap illustrated in FIGS. 1, 2, 3 and 4 comprises a cap 1 made of an elastic or semielastic material preferably of rubber or synthetic resin or of an elastic cloth.

Figure 4:
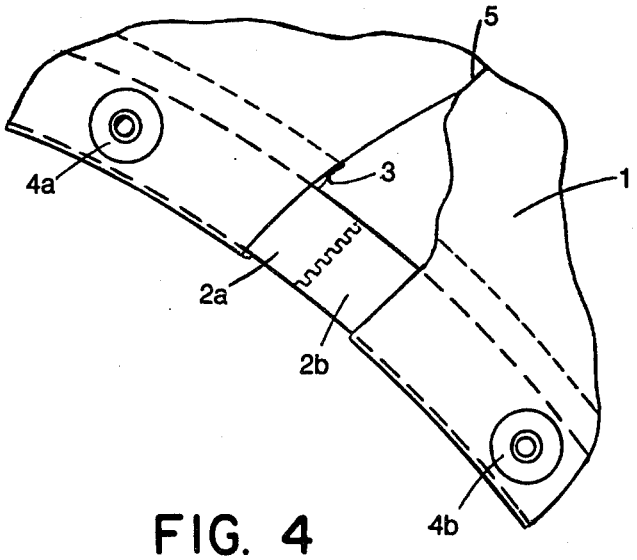
FIG. 4 represents an enlarged and partially sectioned particular of the cap of FIG. 1.

The two segments 2*a* and 2*b* of the deployment clip made of metal or of plastic and hinged together at heir adjacent ends are conveniently inserted inside the hem 3, which is obtained by folding the edge of the cap and sewing it or welding it down inside the cap 1, as illustrated in the enlarged and partially sectioned particular of FIG. 4.

A press-button 4, composed of a female part 4*a* and of a male part 4*b* respectively fixed on the rim of the cap over segments 2*a* and 2*b* of the clip, besides constituting the locking device to block the clip close, it also serves the purpose of fixing the two segments of the clip inside the hem of the cap.

Figure 1:
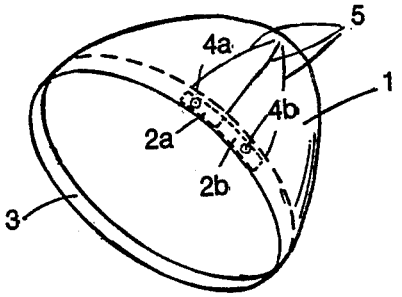
FIG. 1 represents schematically a bathing cap of the invention with the deployment clip open.
Figure 2:
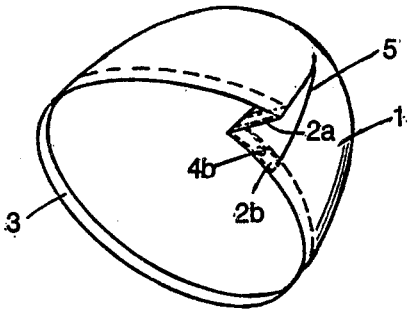
FIG. 2 represents the cap of FIG. 1 with the clip in an intermediate position during fastening.
Figure 3:
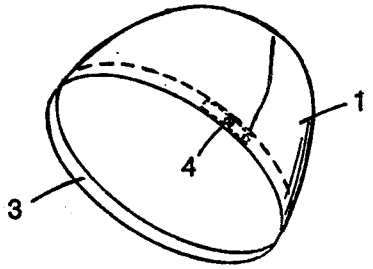
FIG. 3 represents the cap of FIG. 1 with the clip locked close.

As shown in FIG. 1 the cap, if made of a moulded elastomeric material, may advantageously be provided with suitable pleats 5 along the meridian passing through the axis of the hinge of the clip and along those passing about the folding edges in order to selectively facilitate folding of the material of the cap along those meridians during the closing of the clip. In addition the material of the cap in the area defined by the two extreme folding pleats may be advantageously made thinner than its normal thickness in order to reduce bulkyness of the fold.

Figure 5:
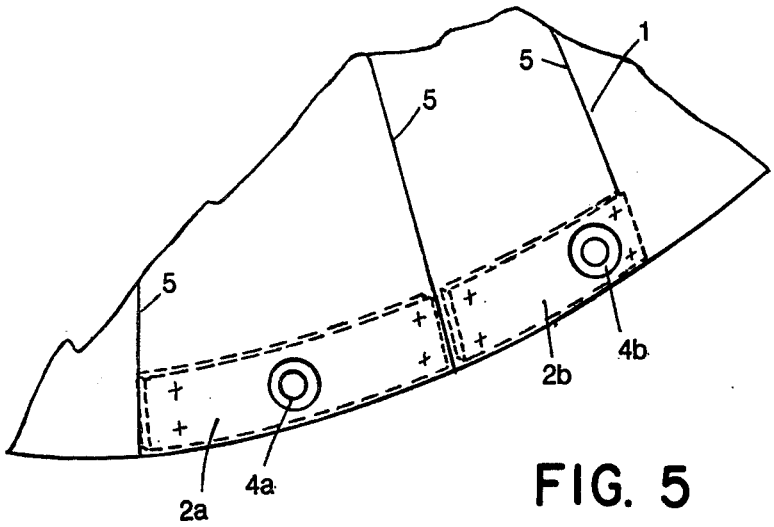
FIG. 5 represents an enlarged particular showing a particularly preferred embodiment of the clip.

In FIG. 5 it is illustrated a particularly simple and effective embodiment of the invention. The deployment clip is realized by fixing two thin bars 2*a* and 2*b* made of a sufficiently rigid material, preferably of a thermoplastic resin, on the inside of the rim of the cap 1, which is preferably made of synthetic rubber. The two bars 2*a* and 2*b* may be fastened to the rim by any appropriate means such as by riveting, by bolting, by glueing or by spot welding the rim and the bars together by any suitable technique such as ultrasonic, high frequency electromagnetic radiation or other welding techniques useful for joining together thermoplastic resins.

The two parts 4*a* and 4*b* forming the press button are mounted respectively on bars 2*a* and 2*b* at the same distance from the adjacent ends.

Therefore the elastomeric material of the rim itself between the two adjacent ends of the two bars 2*a* and 2*b* acts as the hinge of the deployment clip thus formed.

Preferably, the two segments of the clip have different lengths for example, bar 2*a* being about 4 centimeters long and bar 2*b* being about 2.5 centimeters. Therefore, depending on which of the two bars 2*a* and 2*b* is rotated out to overlap the other, the circumference of the rim may be shortened of either a segment of 8 centimeters or of 5 centimeters.

Figure 6:
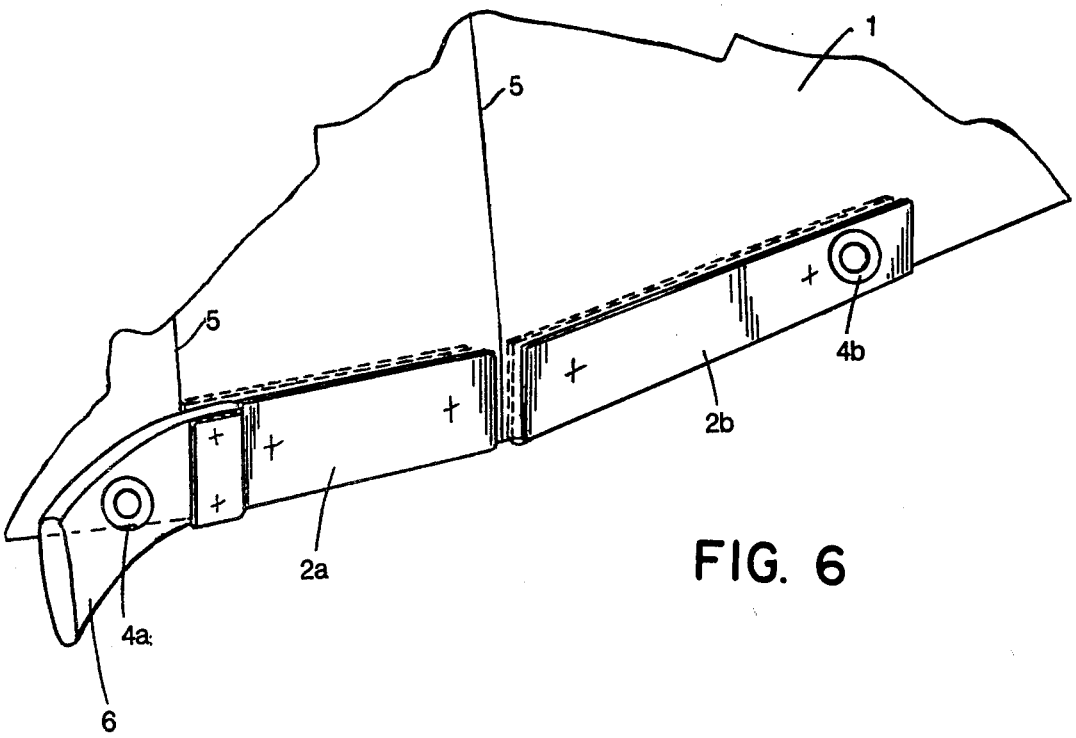
FIG. 6 represents an enlarged particular showing another particularly effective realization of the clip.

In FIG. 6 it is illustrated yet another embodiment of the invention.

The two segments 2*a* and 2*b* of the deployment clip are here constituted by two lengths of a metallic or plastic bar having a narrow "U" cross section which can be slipped over the rim of the cap 1 and thence squeezed to firmly grip on the rim's material. Appropriately providing a suitable profile, either to the rim cross-section or to the surfaces of the "U" bars, the gripping may be rendered extremely firm and secure.

A rubber tongue 6 may be provided for facilitating pulling the clip closed and one part 4*a* of the locking device (press-button in the FIG. 6) may be mounted on the tongue itself. For example, in this embodiment the press button may be substituted by a butterfly button or other positively locking device.

Also in the embodiment of FIG. 6 the hinging of the two segments of the clip is provided by the elastic material of the rim.

Various modifications from the reported embodiment are possible in the practice of the invention, which scope is thought to be expressed in the following claims.

I claim:

1. Bathing cap of elastic or semi-elastic material characterized in that it is provided with at least a deployment-clip which varies the circumference of the rim by a preset segment and wherein the deployment clip is composed of two bars of a substantially rigid material, mounted end to end on the rim of the cap and hinged about their adjacent ends to permit rotation of one bar to overlap the other thus causing the cap to fold about the axis of rotation of the clip and further composed of locking means to hold the clip closed in its folded position.

2. The cap of claim 1 wherein the hinging of the deployment clip is provided for by the elastic material of the rim of the cap.

3. The cap of claim 1 wherein the two bars of the deployment clip have different lengths and the circumference of the cap is varied by a segment substantially equal to the length of the one bar of the clip which is caused to rotate to overlap to the other.

4. The cap of claim 1 wherein the locking means is a press-button.

5. The cap of claim 1 wherein the cap is provided with pleats along the meridian which passes through the axis of rotation of the clip and along the meridians passing about the folding edges of the clip to facilitate folding of the material along such meridians.

* * * * *